United States Patent [19]

Reece

[11] Patent Number: 4,655,639

[45] Date of Patent: Apr. 7, 1987

[54] PLOUGH

[75] Inventor: Alan R. Reece, Wylam, England

[73] Assignee: The British Petroleum Company p.l.c., London, England

[21] Appl. No.: 701,494

[22] Filed: Feb. 14, 1985

Related U.S. Application Data

[63] Continuation of Ser. No. 449,615, Dec. 14, 1982, abandoned.

[51] Int. Cl.[4] ..... E02F 5/10; F16L 1/00

[52] U.S. Cl. ..... 405/181; 37/193; 405/179; 405/174

[58] Field of Search ..... 405/174–184; 37/193

[56] References Cited

U.S. PATENT DOCUMENTS

| | | | |
|---|---|---|---|
| 200,557 | 2/1878 | Mettler et al. | 405/183 X |
| 305,363 | 9/1884 | Webster | 405/181 |
| 668,362 | 2/1901 | Tomlinson | 405/164 X |
| 1,886,510 | 11/1932 | Murphy | 405/181 |
| 2,155,044 | 4/1939 | Gray et al. | 405/181 |
| 3,031,854 | 5/1962 | Willner | 405/183 |
| 3,423,946 | 1/1969 | Maclay | 405/164 |
| 4,079,593 | 3/1978 | Flippin | 405/183 X |

FOREIGN PATENT DOCUMENTS

| | | | |
|---|---|---|---|
| 2519642 | 11/1975 | Fed. Rep. of Germany | 37/193 |
| 1400095 | 7/1975 | United Kingdom . | |
| 1562744 | 3/1980 | United Kingdom . | |
| 2062064 | 5/1981 | United Kingdom . | |

*Primary Examiner*—Dennis L. Taylor

*Attorney, Agent, or Firm*—Morgan & Finnegan

[57] ABSTRACT

A plough for burying cable or pipe comprises at least two cutters laterally spaced apart, one being offset at an angle relative to the other for making two spaced apart cuts in a substrate to form a wedge of material. Means are provided for lifting and moving the wedge upwards and sideways to form a trench and for guiding the cable or pipe into the trench under the lifted wedge.

The plough cuts an improved furrow shape, lifts the furrow slice through the minimum height in order to permit the cable or pipe to be inserted below it and allows the material to be replaced with minimun disturbence.

8 Claims, 4 Drawing Figures

PLOUGH

This is a continuation of application Ser. No. 449,615 filed Dec. 14, 1982, now abandoned.

The present invention relates to a pipe or cable burying plough, more particularly to a plough suitable for use underwater.

Ploughs which have been previously proposed for burying pipes or cables usually consist of a share which forces soil upwards and outwards to form a trench, followed by two parallel faces which hold the soil apart while the cable or pipe is lowered into the bottom of the trench between them. Even though the sides of the share may define a narrow steep sided trench, nevertheless the soil is disturbed and weakened in triangular zones extending upwards on either side of the share. The soil displaced is not returned to the trenh in any controlled way with the result that the trench is not completely refilled and the burial depth of the pipe or cable is less than the depth cut by the plough share. The result is that the pipe or cable lies in the bottom of a relatively shallow wide trench filled with loosened and weakened soil, and inadequate protection is obtained.

The conventional process moves a considerable volume of soil in a way which involves a great deal of internal shearing and consequently requires a high force to pull the plough.

It is an object of the present invention to provide a plough which cuts an improved furrow shape, lifts the furrow slice a smaller distance in order to permit the cable or pipe to be inserted below it, and allows the material to be replaced with minimum disturbance.

Thus according to the present invention there is provided a plough for burying cable or pipe which plough comprises at least two cutters laterally spaced apart, one being offset at an angle relative to the other(s), for making two spaced apart cuts in a substrate to form a wedge of material, means for lifting and moving the wedge upwards and sideways to form a trench and means for guiding the cable or pipe into the trench under the lifted wedge.

After the cable or pipe has been laid and the plough has passed on, the wedge falls back into the trench without assistance and buries the cable or pipe.

Conveniently the plough includes two longitudinally extending sidefaces located rearwards of the cutters to assist in holding the trench walls apart whilst the cable or pipe is guided into the trench.

Preferably these side faces converge towards their leading ends to form the first of said cutters.

One of the sidefaces is preferably flat and the convergence is provided by angling or curving the other.

The arrangement can be such that the cable or pipe is passed between the longitudinally extending side faces into the trench under the lifted wedge.

The second cutter is preferably located in front of the first cutter, laterally spaced apart from it and offset at an angle to it.

Preferably the angle between the planes of the first and second cutters is in the range 15° to 45°, most preferably about 30°.

A third cutter may be included located in front of the first cutter and in line with it.

The second and third cutters may be fixed blades, freely rotating discs, power driven discs, water jets or other means.

The plough is normally intended for operation in a relatively soft substrate such as soil, sand, silt or clay. However, by modifying the second and third cutters to act as saws, the plough can operate in a harder substrate such as rock.

The first cutter preferably has a cutting edge projecting from its lower extremity adapted to engage the wedge cut by the cutters.

The means for lifting the wedge preferably comprises an inclined plane rising from the cutting edge.

The wedge should be given sufficient lift initially to permit sideways movement without jamming against the trench walls.

Cables and pipes frequently contain sections of larger cross section at regular intervals along their lengths. These sections may, for example, be caused by joints or contain amplifiers. Such sections can give rise to problems in burial.

In order to accommodate these enlarged sections the inclined plane can be modified so that it or a continuation thereof, which need not be inclined, can be raised to such a height that the wedge of material is formed up and out of the trench, thereby making room for the enlarged sections.

This can be done, for example, by hinging the inclined plane or its continuation and automatically raising the rear of the hinged section to the height of the trench on receipt of a signal from a detector that the passage of an enlarged section is imminent. After the latter is laid, the rear section drops to its normal level again.

According to another aspect of the present invention there is provided a method for burying a cable or pipe which method comprises the steps of making two laterally spaced apart cuts in a substrate to form a wedge of material, lifting and moving the wedge upwards and sideways to form a trench, guiding the cable or wedge into the trench under the lifted wedge and allowing the wedge to fall back to cover the cable or pipe.

Preferably the trench walls are held apart whilst the cable or pipe is guided into the trench.

The invention is illustrated by reference to the accompanying drawings in which.

Figure 1:
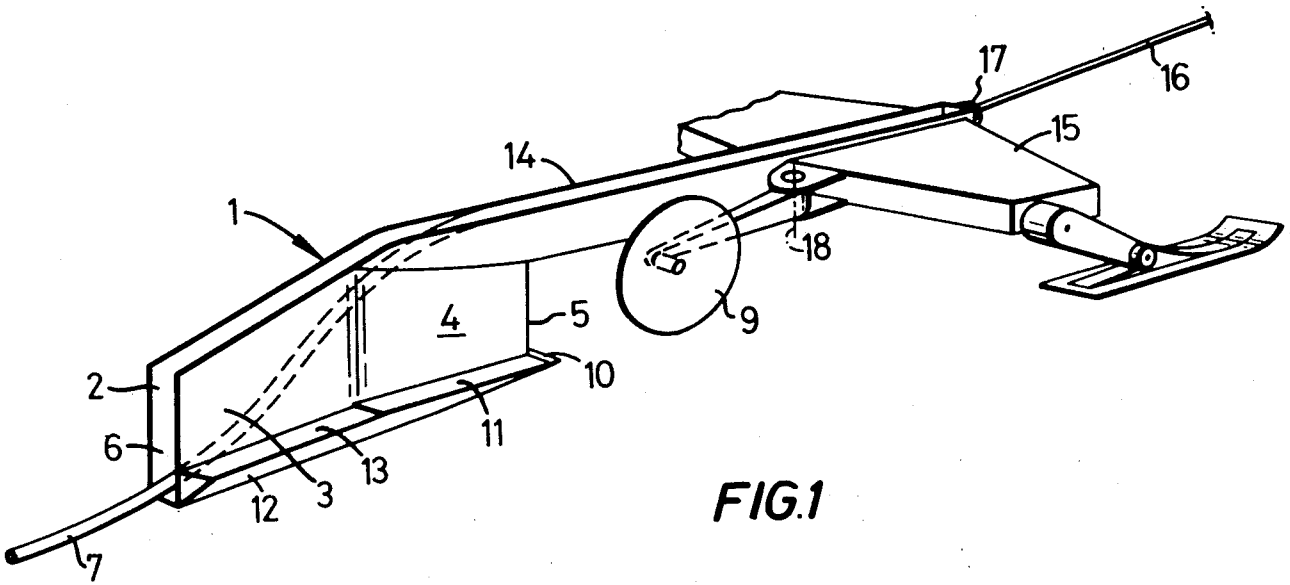
FIG. 1 is a perspective diagrammatic view of a cable-laying plough.

The plough, indicated generally by numeral 1, includes two longitudinally extending side faces 2 and 3, (being faces of a body member 4) face 2 being flat and vertical (but not necessarily so) and face 3 being curved inwardly to meet face 2 and provide a cutting edge 5. Extending through body 4 is a passage 6 through which the cable 7 is passed into the trench under the lifted soil wedge 8.

The plough incorporates a second cutter in the form of a freely rotating disc 9 which together with the cutting edge 5 make two parallel spaced apart cuts in the soil and thereby form a wedge or slice 8. As can be seen from FIG. 2 the cut made by edge 5 is vertical whilst the cut made by disc 9 is inclined to the vertical.

The plough also comprises means for lifting the soil wedge 8 in the form of a horizontal cutting edge 10 and inclined face 11. The inclined face 11 is at the leading end of a wedge shaped member 12 which also has a horizontal surface 13 (which can be slightly inclined if desired).

The plough further includes a beam 14 which connects the body 4 to a supporting structure 15 which conveniently comprises a pair of skids or wheels, one being located on each side. The supporting structure 15 is adjustable by means not shown to control the depth of the cuts. The plough is pulled by a tow rope 16 connected to a hitch point 17 in the form of an eye.

Figure 2:
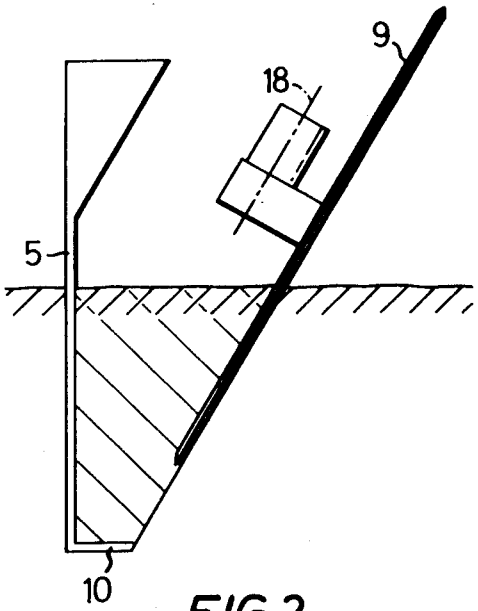
FIGS. 2, 3 and 4 show cross-sections through the soil before during and after passage of the plough.

In use the cutters 5 and 9 cut the sides of the soil wedge which is to be lifted by the plough as shown in FIG. 2. The wedge or slice is trapezoidal in section, wider at the top than the bottom, and has one vertical side and one at 30° to the vertical.

Figure 3:
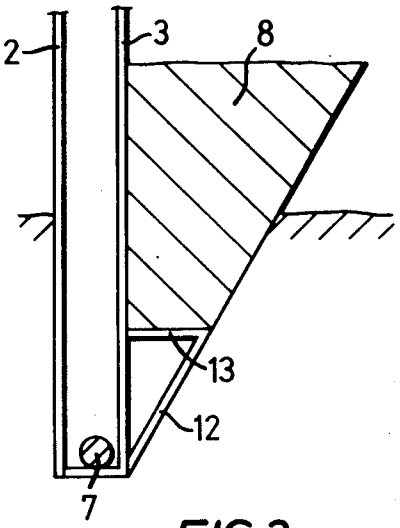

FIG. 3 shows the way in which the plough body 4 moves the wedge or slice upward by means of the upper surfaces 11 and 13 on the projection 12 while the side face 3 moves it sideways, to leave room for the plough body 4 to pass through the soil. The detailed geometry of the curved side 3 and lifting surface 11 is arranged so that the soil slice is always lifted sufficiently first to permit sideways movement without jamming against the walls. The flatter is the sloping wall the less the required lift but the greater the amount of soil to be moved. 30° is often a convenient angle but others may be appropriate in particular cases.

Figure 4:
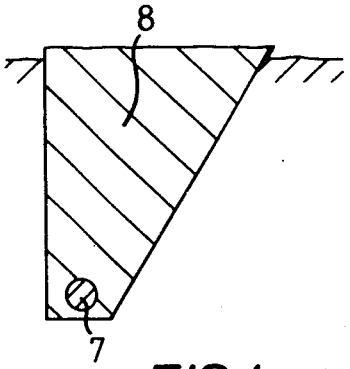

FIG. 4 shows that when the plough body 4 moves on, the wedge or slice will fall back on top of the pipe or cable, to fill the trench completely and provide improved protection.

The cutters 5 and 9 should be as narrow and sharp as possible to cut the wedge or slice with the minimum soil disturbance.

It may not be convenient to cut the sides of the trench to the full depth and the lower parts of the wedge walls may be left to crack open. Alternatively water jets projecting forward from the cutting edges 5 and 10 may be used to complete the cutting of the wedge or slice.

The disc cutter 9 making the sloping trench wall can be pivotted about an axis 18 in front of the disc and parallel to the plane of the disc as shown in FIGS. 1 and 2 to provide some freedom of movement if an obstacle is encountered.

The advantage of the above illustrated plough is that it handles the wedge in such a way as to reduce the strains in it, and therefore reduce the pulling force. It leaves the cable or pipe beneath soil which has suffered significantly reduced weakening as compared with previously described ploughs.

When the plough is used for laying a cable it will usually be desirable to employ a pivotted curved plate (not shown and known to those skilled in the art as a "dipper") attached to the plough beam 14 to urge the cable into the channel 6 so that the cable emerges from the base of the channel.

I claim:

1. A plough for burying cable or pipe which plough comprises a plough body having fixed thereto at least a first and second cutter offset to each other so as to make two spaced apart cuts in a substrate to form a wedge of material and the said second cutter being able to move laterally with respect to the first cutter wherein the said first cutter comprises a substantially vertical portion having a substantially horizontal cutting edge projecting from its lower extremity there being an inclined plane of substantially the same width as the said substantially horizontal cutting edge rising upwards and to the rear of the said cutting edge which width is sufficient to lift the said wedge of material upwards and sideways to form a trench there being a passage through the said plough body down which the cable or pipe is guided into said trench.

2. A plough as claimed in claim 1 in which the second cutter is positioned in front of the first cutter in the direction of travel of the plough.

3. A plough as claimed in claim 1 or 2 in which the second cutter is a disc.

4. A plough as claimed in claim 1 or 2 in which the second cutter is a knife.

5. A plough as claimed in claim 1 or 2 in which the first cutter has a substantially vertically mounted cutting edge and the second cutter is positioned at an angle to the vertical.

6. A plough as claimed in claim 1 in which the second cutter is a disc cutter mounted at an angle of 15° to 45° to the vertical and the first cutter has a substantially vertical cutting edge.

7. A plough as claimed in claim 1 or 6 in which there is a third cutter mounted in front of the first cutter and in line with it.

8. A plough as claimed in claim 1 in which there are two longitudinally extending side faces located rearward of the cutters to assist in holding the trench walls apart whilst the cable or pipe is guided into the trench, the said side faces being spaced apart at their rearward end and converging towards their leading ends to form the said first cutter.

* * * * *